US006024866A

United States Patent [19]

Weers et al.

[11] Patent Number: 6,024,866

[45] **Date of Patent: *Feb. 15, 2000**

[54] METHOD OF SCAVENGING HYDROGEN SULFIDE FROM HYDROCARBONS

[75] Inventors: Jerry J. Weers, Ballwin; Timothy J. O'Brien, St. Louis, both of Mo.

[73] Assignee: Baker-Hughes Incorporated, Houston, Tex.

[ * ] Notice: This patent is subject to a terminal disclaimer.

[21] Appl. No.: 08/139,893

[22] Filed: Oct. 19, 1993

Related U.S. Application Data

[63] Continuation of application No. 08/031,062, Mar. 12, 1993, Pat. No. 5,284,576, which is a continuation of application No. 07/388,210, Aug. 1, 1989, abandoned.

[51] Int. Cl.[7] ..... C10G 29/20

[52] U.S. Cl. ..... 208/236; 208/47; 208/237; 208/348

[58] Field of Search ..... 208/237, 236, 208/47, 348

[56] References Cited

U.S. PATENT DOCUMENTS

| | | | |
|---|---|---|---|
| B 311,977 | 1/1975 | Woodruff | 252/182 |
| 2,238,201 | 4/1941 | Wilson et al. | 196/32 |
| 2,309,871 | 2/1943 | Schulze et al. | 196/27 |
| 2,426,318 | 8/1947 | Menaul | 252/8.55 |
| 2,496,595 | 2/1950 | Moyer et al. | 252/8.55 |
| 2,596,273 | 5/1952 | Moyer et al. | 252/8.55 |
| 3,025,313 | 3/1962 | Gunderson | 260/404.5 |
| 3,819,328 | 6/1974 | Go | 208/47 |
| 3,925,233 | 12/1975 | Woodruff | 252/182 |
| 4,202,882 | 5/1980 | Schwartz | 424/76 |
| 4,217,238 | 8/1980 | Sartori et al. | 252/192 |
| 4,388,213 | 6/1983 | Oppenlaender et al. | 252/392 |
| 4,501,668 | 2/1985 | Merk et al. | 210/749 |
| 4,515,759 | 5/1985 | Burnes et al. | 423/220 |
| 4,569,766 | 2/1986 | Kool et al. | 210/690 |
| 4,575,455 | 3/1986 | Miller | 423/228 |
| 4,581,154 | 4/1986 | Kutsher et al. | 252/170 |
| 4,605,478 | 8/1986 | Christenson et al. | 204/181.7 |
| 4,680,127 | 7/1987 | Edmonson | 210/749 |
| 4,778,609 | 10/1988 | Koch et al. | 252/32.5 |
| 4,877,578 | 10/1989 | Zetlmeisl et al. | 422/14 |
| 4,894,178 | 1/1990 | Ho et al. | 252/189 |
| 4,894,179 | 1/1990 | Santori et al. | 252/189 |
| 5,169,411 | 12/1992 | Weers | 44/421 |
| 5,284,576 | 2/1994 | Weers et al. | 208/236 |

OTHER PUBLICATIONS

Acid Gas Absorption by Solns. of Modified aliphatic polyamines Giavarini, (Italy) 1973.

*Primary Examiner*—Helane Myers
*Attorney, Agent, or Firm*—Howell & Haferkamp, LC

[57] ABSTRACT

Hydrocarbons, gas mixtures of hydrocarbons, and the like containing hydrogen sulfide are brought into intimate contact with a hydrogen sulfide scavenger prepared by reacting an alkylenepolyamine with formaldehyde, whereby the amount of hydrogen sulfide in the hydrocarbon is significantly reduced.

22 Claims, No Drawings

METHOD OF SCAVENGING HYDROGEN SULFIDE FROM HYDROCARBONS

This application is a continuation application of prior U.S. application Ser. No. 08/031,062, filed Mar. 12, 1993 (now U.S. Pat. No. 5,284,576, which issued Feb. 8, 1994), which is a file wrapper continuation of U.S. patent application Ser. No. 07/388,210, filed Aug. 1, 1989 (abandoned).

BACKGROUND OF THE INVENTION

The present invention relates to a method of reducing or scavenging hydrogen sulfide associated with or in a hydrocarbon stock. More particularly, the present invention relates to a method of reducing or scavenging hydrogen sulfide in a liquid hydrocarbon stock and/or gaseous hydrocarbon stock in admixture with hydrogen sulfide gas.

In the drilling, production, transport, storage, and processing of crude oil, including waste water associated with crude oil production, and in the storage of residual fuel oil, hydrogen sulfide which is a very toxic substance is often encountered. Also, at the oil well head, hydrogen sulfide-containing light hydrocarbon vapors are emitted and must be controlled. Uncontrolled emission of hydrogen sulfide gives rise to severe health hazards. Burning of such vapors neither solves the toxic gas problem nor is economical since the light hydrocarbons have significant value. Furthermore, hydrogen sulfide is often present in the underground water removed with the crude oil, in the crude oil itself and in the gases associated with such water and oil. When the water and oil are separated one from the other by the use of separation tanks, demulsification apparatus and the like, intolerable amounts of hydrogen sulfide are emitted as a gas which is associated with water and hydrocarbon vapors. Natural gases are often sour; that is they contain some hydrogen sulfides.

In accordance with the present invention, crude oil production fluids containing hydrogen sulfide, as well as hydrocarbon gases, such as natural gas or off gas production fluids from the production, transport, storage, and refining of crude oil can be controlled in a convenient and economical manner.

The Prior Art

The use of various aldehydes which react with hydrogen sulfide has been known in the prior art for sometime. For example, U.S. Pat. No. 2,426,318 discloses a method of inhibiting the corrosive action of natural gas and oil containing soluble sulfides on metals by utilizing certain aldehydes, preferably formaldehyde.

U.S. Pat. No. 4,680,127 suggests using glyoxal to reduce the amount of hydrogen sulfide in hydrogen sulfide-containing dry gaseous and wet gaseous media.

U.S. Pat. No. 4,515,759 discloses a process for removal of hydrogen sulfide from gas mixtures, particularly gas mixtures containing hydrocarbons, wherein the gas mixture is treated with a buffered aqueous solution of a water soluble nitrite, such as sodium nitrite.

There is a need in the liquid fuel industry for treating a liquid hydrocarbon stock and a wet or dry gas mixture containing hydrogen sulfide and a low boiling or light hydrocarbon with a highly effective chemical agent that is both water and hydrocarbon soluble. Thus, when the gaseous mixture is wet, the agent will scavenge the hydrogen sulfide from both the aqueous vapors and the hydrocarbon vapors.

SUMMARY OF THE PRESENT INVENTION

In accordance with the present invention, there is provided an effective and economical process for scavenging hydrogen sulfide in hydrocarbon production fluids, associated gases, residual fuel and waste water, including liquids (such as liquid hydrocarbons) or in dry or aqueous, gaseous mixtures of hydrogen sulfide and low boiling hydrocarbons, such as methane, ethane, propane, etc., emitted during the removing of crude oil from the ground, the storage of the oil, the separation of the oil from oil well water, waste water, transport of the oil, and the oil refining. Also, the invention is useful in scavenging hydrogen sulfide in residual oil fuels. Thus, this method may be used to treat hydrocarbon production fluids, associated gas produced during hydrocarbon production and refinery waste water. The hydrogen scavenging of the present invention is accomplished by intimately mixing or contacting the hydrogen sulfide-containing substance with an effective hydrogen sulfide scavenging amount of the reaction product of certain alkylenepolyamines and formaldehyde. Depending on the size of the alkylene moiety, the scavenger can be water soluble and/or petroleum hydrocarbon soluble. Having both water solubility and oil solubility can be advantageous in many case.

DETAILED DESCRIPTION OF THE INVENTION

The present invention comprises a method including the step of bringing into reactive intimate contact a liquid hydrocarbon, such as crude oil, petroleum residual fuel and the like with a reaction product of certain alkylenepolyamines and formaldehyde. Instead of contacting the reaction product with a liquid hydrocarbon, the reaction product can be contacted with wet or dry gaseous mixtures of hydrogen sulfide and hydrocarbon vapors, such as is found in natural gas or obtained in the drilling, removal from the ground, storage, transport, and processing of crude oil.

The hydrogen sulfide scavengers of the present invention are prepared by reacting alkylenepolyamines and formaldehyde in a known manner. Where water is present, the alkylenepolyamine is selected so that the reaction product is preferably soluble both in water and hydrocarbon stock. The polyamines useful in the preparation of the hydrogen sulfide scavengers useful in the method of the present invention are alkylenepolyamines represented by the formula $$H_2NRNH\text{-}(RNH)_x\text{-}H$$

wherein each R is independently an alkylene radical having 2 to about 20 carbon atoms and x is 0 to about 15. The alkylene radical may be straight or branched chain, e.g., ethylene, methylethylene, trimethylene, phenylethylene and may be substituted with one or more organic or inorganic radicals that do not react with formaldehyde, e.g., halo such as chloro, bromo, fluoro, alkyloxy, etc. As a practical matter, however, the alkylene radical is preferably a straight chain lower alkylene, e.g., ethylene or propylene and any suitable lower alkyl substituent thereon, such as methyl, ethyl, etc. Where water solubility of the scavenger is of lesser importance, the alkylene radical of the polyamine may be derived from fatty materials, such as tallow.

Representative polyamines include ethylenediamine, propylenediamine, diethylenetriamine, triethylenetetramine, tetraethylenepentamine, tetrabutylenepentamine, hexaethyleneheptamine, hexapentyleneheptamine, heptaethyleneoctamine, octaethylenenonamine, nonaethylenedecamine, decaethyleneundecamine, decahexyleneundecamine, undecaethylenedodecamine, dodecaethylenetridecamine, tridecaethylenetetradecamine, N-tallow propylenediamine and higher polyamines.

In general, the scavenging compounds of the present invention are prepared by the exothermic reaction of an alkylenepolyamine, e.g., diethylenediamine, and formaldehyde. The mole ratio of polyamine to formaldehyde may range from about 1:1 to about 1:14, preferably about 1:1 to about 1:3. The reaction temperature is maintained at about 50°–60° C. The reaction may occur over a period of approximately an hour at a time. A temperature drop indicates the completion of the reaction. The resulting reaction product is a complex mixture of compounds, including, for example, methylene-bridged diethylenetriamines.

In general, the hydrogen sulfide scavengers used in the method of the present invention are injected into or otherwise brought into intimate contact with the liquid hydrocarbon, hydrogen sulfide and water in any convenient manner. If hydrogen sulfide emissions from a residual fuel oil are a problem, then the polyamine-formaldehyde reaction product is stirred into the fuel oil. If hydrogen sulfide in natural gas is a problem, the natural gas may be scrubbed with an aqueous or nonaqueous solution of the reaction product. Additionally, when the natural gas, as it often does, contains water vapors, the reaction product in aqueous or nonaqueous solution is injected into a stream of the gas moving within a conduit. In such case, when the water vapors are removed from the natural gas as a liquid, so also will the product of the hydrogen sulfide and the scavenger be removed. The polyamine-formaldehyde reaction product can be used in scavenging hydrogen sulfide from the recovered substances obtained form subterranean wells.

The polyamine-formaldehyde reaction product may be added to any aqueous or nonaqueous medium containing hydrogen sulfide where the amount of hydrogen sulfide is sought to be reduced. Wet gaseous mediums are those containing water vapors and hydrocarbon vapors whose hydrogen sulfide content is excessive. Thus, the method of present invention is useful in controlling hydrogen sulfide in water systems, oil and gas production and storage systems, and other similar systems.

The amount of the polyamine-formaldehyde reaction product used in accordance with the present invention will depend on the amount of the hydrogen sulfide in the medium being treated. In general, the amount of the polyamine-formaldehyde reaction product added to the medium being treated is small but is at least an effective hydrogen sulfide scavenging amount, for example, from about 20 ppm to about 2,000 ppm or more, preferably from about 40 to about 1,200 ppm, and more preferably from about 80 to about 800 ppm. Amounts of scavenger exceeding 10,000 ppm can be employed; but in general, there is no commercial or technical advantage in so doing.

The hydrogen sulfide scavengers may be added neat or diluted with water or solvent and may be formulated or blended with other suitable materials or additives.

The following examples serve to merely illustrate specific embodiments of the invention and the best known mode of practice thereof. Accordingly, the examples are not to be considered in any respect as a limitation of the scope thereof. In the following examples, all percentages are given on a weight basis unless otherwise indicated.

EXAMPLE 1

In this example, the hydrogen sulfide scavenger which is the reaction product of diethylenetriamine and formaldehyde is prepared. Such product is the preferred scavenger. One skilled in the art will readily recognize that the reaction product of formaldehyde and other polyamines can be prepared in a similar manner.

Diethylenetriamine (14.54 g) (0.14 mole) was heated to 50° C. in isopropyl alcohol solvent (12.41 g) while stirring in a three-necked round bottom flask. When the temperature stabilized, formaldehyde (35.32 g) (0.44 mole) of a 37% aqueous solution) was added to the flask from a dropping funnel. Since the reaction is exothermic, the reaction flask was cooled to maintain a steady temperature of 50°–60° C. during addition. After the formaldehyde had all been added, the reaction was stirred at 50°–60° C. for another 15 minutes, and then cooled. At this point the composition can be used neat or diluted with water as desired.

$H_2S$ Reduction Test Procedure

In the following examples, the effectiveness of the scavengers is determined by the following hydrogen sulfide gas evolution analysis. Into a metal container, the polyamine formaldehyde reaction product and 500 g of the selected hydrocarbon stock are charged at ambient temperature. After capping the container, the container and the contents therein are heated in a constant temperature bath for 60 minutes at 82° C. The container is then removed from the bath and shaken in a shaking device for 30 seconds. Thereafter, the container and the contents are again heated at 82° C. for another 30 minutes. Then the container and the contents are shaken again for 30 seconds. Immediately after the second shaking, the cap is replaced with a one hole stopper. Connected to the stopper hole is a Dräger tube whose other end is connected to a Dräger gas detector pump. With one stroke of the pump, a gas sample is withdrawn through the tube. The tube is removed from the container. Thereafter, two strokes of pure air are brought through the tube allowing the absorbed hydrogen sulfide to convert quantitatively. The length of the discoloration in the tube blackened by $H_2S$ corresponds to the hydrogen sulfide concentration in the vapor above the liquid in the container. Alternatively, the headspace gas after the second shaking can be analyzed using a gas chromatograph connected to a mass spectrometer or other suitable device for quantitatively measuring $H_2S$.

EXAMPLE 2

In this example, the amount of headspace hydrogen sulfide was determined using the above-described test procedure evolved from an untreated No. 6 residual fuel oil. A headspace hydrogen sulfide content of such fuel oil was found to be 43,255 ppm.

250 ppm of the neat reaction product made in accordance with Example 1 without being diluted was intimately mixed with an aliquot of the same fuel oil. The amount of headspace hydrogen sulfide in the thus treated fuel oil was determined. It was found that the headspace hydrogen sulfide had been reduced to 3,363 ppm which amounts to a hydrogen sulfide reduction of 92%.

EXAMPLE 3

Example 2 was repeated except that a decant oil (catalytic cracking unit bottoms) was used as the hydrogen sulfide containing stock instead of residual fuel oil. It was determined that the headspace hydrogen sulfide of the untreated decant oil was 3,250 ppm. 61 ppm of the reaction product of Example 1 was intimately mixed with an aliquot of the same decant oil used in the present example. The amount of headspace hydrogen sulfide in the thus treated decant oil was determined to be only 572 ppm which amounts to a hydrogen sulfide reduction of 82%.

EXAMPLE 4

Example 2 was repeated except that a different residual fuel oil was used. The fuel oil in this example was tested to have a headspace hydrogen sulfide of 6,000 ppm. 1,000 ppm of the reaction product of Example 1 was intimately mixed with an aliquot of the same fuel oil used in the present example. The amount of headspace hydrogen sulfide was determined to be only 1,200 ppm. In a separate test, 1,500 ppm of the same reaction product of Example 1 was intimately mixed with an aliquot of the same fuel oil used in the present example. The amount of headspace hydrogen sulfide was determined to be only 800 ppm with this higher amount of reaction product.

While the illustrative embodiments of the invention have been described with particularity, it will be understood that various other modifications will be apparent to and can be readily made by those skilled in the art without departing from the spirit and scope of the invention. Accordingly, it is not intended that the scope of the claims appended hereto be limited to the examples and descriptions set forth hereinabove but rather that the claims be construed as encompassing all the features of patentable novelty which reside in the present invention, including all features which would be treated as equivalents thereof by those skilled in the art to which the invention pertains.

What is claimed is:

1. A process for scavenging hydrogen sulfide from a sour fluid containing hydrogen sulfide and comprising production fluid, associate gas, residual fuel oil or waste water, the process comprising bringing said sour fluid into intimate mixture with a hydrogen sulfide scavenging amount of a hydrogen sulfide scavenger prepared by reacting under non-dehydrating conditions an alkylenepolyamine and formaldehyde wherein the alkylene polyamine is represented by the formula $$H_2NRNH\text{-}(RNH)_x\text{-}H$$

wherein each R is independently an alkylene radical having 2 to about 20 carbon atoms and x is 0 to about 15, thereby scavenging hydrogen sulfide in the sour fluid by effecting a reaction between hydrogen sulfide in the sour fluid and the scavenger.

2. The process of claim 1 wherein the sour fluid is a liquid hydrocarbon or water.

3. The process of claim 2 wherein the liquid hydrocarbon is crude oil.

4. The process of claim 2 wherein the liquid hydrocarbon is residual fuel oil.

5. The process of claim 1 wherein the sour fluid is gaseous in admixture with water vapor.

6. The process of claim 1 wherein the scavenger is present in an amount of from about 20 ppm to about 2,000 ppm.

7. The process of claim 1 wherein the scavenger is the reaction product of diethylenetriamine and formaldehyde in a mole ratio of about 1:1 to 1:3.

8. The process of claim 1 wherein the scavenger is the reaction product of ethylene diamine and formaldehyde in a mole ratio of about 1:1 to about 1:3.

9. The process of claim 1 wherein a vapor containing hydrogen sulfide is associated with the sour fluid and the process reduces the content of hydrogen sulfide in the vapor by at least about 80%.

10. The process of claim 9 wherein the scavenger composition contains methylene-bridged ethylene diamines.

11. The process of claim 1 wherein the sour fluid is a vapor and the process reduces the content of hydrogen sulfide in the vapor by at least about 80%.

12. The process of claim 1 wherein the sour fluid is a hydrocarbon and a vapor containing hydrogen sulfide is associated with the hydrocarbon and the process reduces the content of hydrogen sulfide in the vapor by at least about 80%.

13. The process of claim 1 wherein the sour fluid is a hydrocarbon vapor and the process reduces the content of hydrogen sulfide in the vapor by at least about 80%.

14. The process of claim 1 wherein the scavenger composition contains methylene-bridged diethylenetriamines.

15. The process of claim 1 wherein the hydrogen sulfide scavenger is free of imines.

16. The process of claim 1 wherein the sour fluid is free of ammonium chloride.

17. A process for scavenging hydrogen sulfide from a sour fluid containing hydrogen sulfide and comprising production fluid, associate gas, residual fuel oil or waste water, the process comprising bringing said sour fluid into intimate mixture with a hydrogen sulfide scavenging amount of a hydrogen sulfide scavenger prepared by reacting under non-dehydrating conditions an alkylenepolyamine and formaldehyde wherein the alkylene polyamine is represented by the formula $$H_2NRNH\text{-}(RNH)_x\text{-}H$$

wherein each R is independently an alkylene radical having 2 to about 20 carbon atoms and x is 0 to about 15, thereby scavenging hydrogen sulfide in the sour fluid by effecting a reaction between hydrogen sulfide in the sour fluid and the scavenger, thereby to reduce the content of hydrogen sulfide in the sour fluid substantially.

18. The process of claim 17 wherein the content of hydrogen sulfide in the sour fluid is reduced by at least about 80%.

19. The process of claim 18 wherein the sour fluid is a liquid hydrocarbon or water.

20. The process of claim 18 wherein the sour fluid is gaseous in admixture with water vapor.

21. The process of claim 19 wherein the liquid hydrocarbon is crude oil.

22. The process of claim 19 wherein the liquid hydrocarbon is residual fuel oil.

* * * * *